United States Patent [19]

Senn

[11] Patent Number: 4,722,369

[45] Date of Patent: Feb. 2, 1988

[54] TAKE-UP DEVICE FOR THE CLOTH BEAM OF A TEXTILE MACHINE

[75] Inventor: Georg Senn, Ruti, Switzerland

[73] Assignee: Sulzer Brothers Limited, Winterthur, Switzerland

[21] Appl. No.: 935,585

[22] Filed: Nov. 26, 1986

[30] Foreign Application Priority Data

Dec. 6, 1985 [CH] Switzerland ..... 05213/85

[51] Int. Cl.[4] ..... D03D 49/20

[52] U.S. Cl. ..... 139/308

[58] Field of Search ..... 139/114, 304, 307, 308, 139/309, 92; 66/149 R, 152; 226/186, 187; 242/65, 66, 76

[56] References Cited

U.S. PATENT DOCUMENTS

| | | | |
|---|---|---|---|
| 3,910,319 | 10/1975 | Bassing et al. | 139/308 |
| 4,125,131 | 11/1978 | Porter | 139/308 |
| 4,273,163 | 6/1981 | Pfarrwaller | 139/308 |
| 4,643,232 | 2/1987 | Wagner | 139/92 |

*Primary Examiner*—Henry S. Jaudon

*Attorney, Agent, or Firm*—Kenyon & Kenyon

[57] ABSTRACT

The cloth take-up device comprises a pressing device having a flexible pressure hose which is connectable to a pressure source and which presses a presser on to the cloth take-up roll. The pressure applied by the presser to the roll can be varied in a simple manner by variation of the pressure in the pressure hose and adapted to varying operating requirements. Delicate materials are taken up gently when a pressing roll driven at the peripheral velocity of the take-up roll is used.

20 Claims, 5 Drawing Figures

TAKE-UP DEVICE FOR THE CLOTH BEAM OF A TEXTILE MACHINE

This invention relates to a take-up device for the cloth beam of a textile machine, particularly a loom.

As is known, textile machines such as looms have usually been provided with a take-up roll and cloth deflecting elements upstream of a cloth beam in order to take up the cloth formed in the textile machine. Usually, the take-up roll is driven while the deflecting elements are disposed one before and one after the roll with a gap between the elements which is less than the diameter of the roll. In many cases, the normal tensions in a web of cloth automatically presses a moving take-up roll against the deflecting elements with sufficient force for the roll to take up the cloth without slipping and for the requisite warp tension to be maintained. However, should the tension in the cloth decrease, for example, in the event of a disturbance in warp let-off or in the cloth beam drive, the automatically produced pressure becomes insufficient to ensure take-up without slipping . Accordingly, additional pressure is required. To this end, it has been known to provide a pressing device to press the roll against the deflecting elements substantially over the length of the roll.

In some cases, for example, as described in Swiss Pat. No. 615,644 and U.S. Pat. No. 4,273,163, springs have been used to press a rail-like or rod-like presser of a pressing device against the take-up roll. Usually, this construction operates satisfactorily on a given cloth made of a given material of given rib width and with a given strength force. However, when a machine is used to produce a variety of articles, the pressure which the presser applies may have to be adapted to circumstances and either increased or decreased.

In the case of delicate articles, such as some fabrics of synthetic or glass fibers, friction between the fabric and the presser may damage the article. Thus, pressing is undesirable in normal loom operation. Hence, the pressure must be disengaged from the take-up roll. Further, when a new warp is being fed to a loom, the presser must be disengaged from the take-up roll. Various devices which have been known for meeting these requirements have only done so through the agency of elaborate engineering steps. In particular, the pressing device described in Swiss Pat. No. 615,644 cannot meet the requirements for varying the pressure of a presser. Instead, the pressure can be varied only through the agency of elaborate constructional devices.

Accordingly, it is an object of the invention to provide a take-up device which is able to produce to a uniform pressure which can be adjusted from time-to-time in a simple manner.

It is another object of the invention to be able to adjust the pressure of a presser on a take-up roll of a take-up device in a simple manner.

It is another object of the invention to adapt the pressure in a take-up device to changing requirements.

Briefly, the invention provides a take-up device for a cloth beam of a textile machine which comprises a rotatable roll for receiving a web of cloth, a pair of deflecting elements parallel to the roll for deflecting the web of cloth over the roll, a presser extending longitudinally of the roll and a pressure control means for moving the presser towards and against the roll.

The pressure control means includes a hollow flexible-walled member which is connectable to a pressure source for inflating the member in order to move the presser towards the take-up roll.

Varying the pressure in the flexible hollow member ensures a rapid and accurate adaptation in line with changing requirements of the pressure which the presser applies to the take-up roll so that cloth take-up is always gentle. Also, the pressure which the presser applies is uniform over the whole width of the cloth, yet the presser remains able to adapt, where necessary, to particular surface structure of the cloth.

Air is the preferred pressure medium in the case of air jet looms. However, a take-up device in which the pressure is reduced hydraulically or hydropneumatically may be advantagous. Pressure can be built-up very quickly if a chamber of the hollow member contains liquid and is separated from the compressed air by a resilient diaphragm. In such a construction, compressed air acts by way of the diaphragm on the liquid in the chamber. The pressure in the hollow member and, therefore, the presser applied by the pressure build-up more rapidly at cut-in since only a fraction of the volume of the hollow member needs to be filled with compressed air.

These and other objects and advantages of the invention will become more apparent from the following detailed description taken in conjunction with the accompanying drawings wherein.

Figure 1:
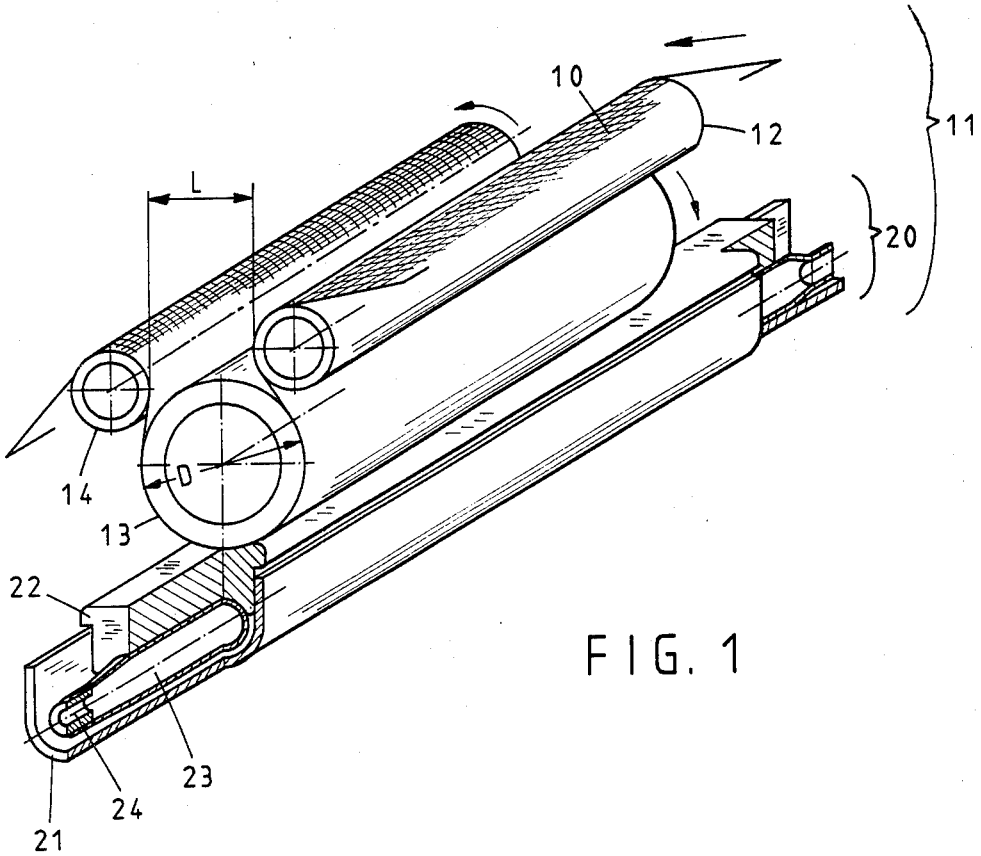
FIG. 1 illustrates a diagrammatic perspective view of a cloth take-up device constructed in accordance with the invention.

Referring to FIG. 1, the cloth take-up device 11 for a cloth beam of a textile machine such as a loom (not shown) is positioned to receive a web 10 of cloth upstream of a cloth beam (not shown). The take-up device 11 includes a floating take-up roll 13 and a pair of deflecting elements in the form of a stationary feed roll 12 and a stationary delivery roll 14. As indicated, the feed roll 12 and delivery roll 14 are disposed on opposite sides of the take-up roll 13 and define a gap L which is of less extent than the outside diameter D of the take-up roll 13. As shown, the take-up roll may be hollow.

During operation, the deflecting rolls 12, 14 pass the web 10 over the take-up roll 13. During this time, the tension which is operative in the direction in which the web 10 moves presses the floating take-up roll 13 uniformly against the stationary rolls 12, 14. The pressure is higher in proportion as the tension in the web 10 is greater.

The floating take-up roll 13 is mounted so as to be moved transversely of its longitudinal axis. In addition, the take-up roll 13 is driven laterally by way of a ball joint or universal joint (not shown). The stationary rolls 12, 14 can also be driven laterally at the peripheral velocity of the floating roll 13 or can be simply mounted for rotation and be driven by the floating roll 13 by way of the web 10. Often, the feed roll 12 is in the form of a temple roll having a screw threaded structure of opposite direction extending from the center to both sides.

The take-up device is also provided with a pressing device 20 which is operative to increase or decrease the pressure which the take-up roll 13 applies to the web 10 and to the stationary rolls 12, 14. This pressing device 20 includes a channel-section carrier 21, a presser in the form of a pressing rail or rod 22 which extends longitudinally of the floating roll 13 and a pressure controlled means extending for moving the pressing rail 22 longitudinally along the rail 22 uniformly towards and against the floating roll 13. In the illustrated embodiment, the pressure control means includes a hollow flexible-walled member in the form of a resilient pressure hose 23 of elastic material. This hose 23 is connectable to a pressure source (not shown) such as a source of compressed air through an inlet 24 for inflation of the hose 23 in order to move the pressing rail 22 against the take-up roll 13 and web 10 thereon.

During operation, the presser pressure is adapted to the operating requirements by variation of the pressure in the hose 23. When the hose is completely pressureless, the pressing rail 22 disengages from the take-up roll 13 and does not press at all against the web 10 and roll 13.

Figure 2:
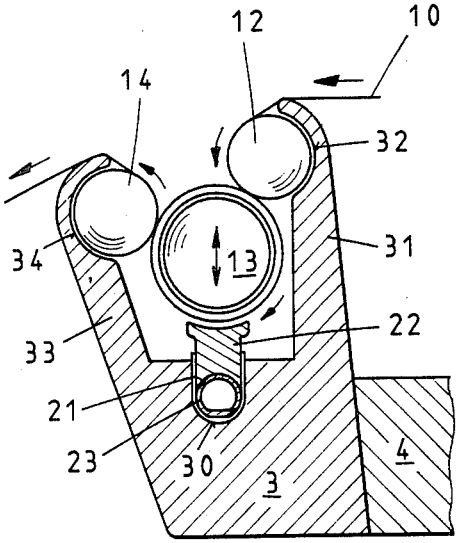
FIG. 2 illustrates a side view of the take-up device of FIG. 1.

Referring to FIG. 2, wherein like reference characters indicate like parts as above, the deflecting rolls 12, 14 can be mounted for rotation in trough-like recesses 32, 34 in U-shaped arms 31, 33 of a holder 3. In this respect, a plurality of similar holders 3 may be arranged over the width of the loom with each being fixedly connected to a frame 4 of the loom. As illustrated, the carrier 21 of the pressing device 20 is secured in a recess 30 of the holder 3.

The pressing rail 22 is made, for example, of a resilient deformable material so that the pressing surface which faces the floating roll 13 can be adapted like a trough to the periphery of the floating roll 13. Alternatively, the pressing surface of the pressing rail 22 may be trough-shaped as illustrated. In any event, at least the pressing surface of the pressing rail 22 is made of a material, such as nylon or Teflon which applies little friction to the web 10.

The pressing rail surface which faces the hose 23 is shaped in a trough-like manner to accommodate the surface of the hose 23.

Figure 3:
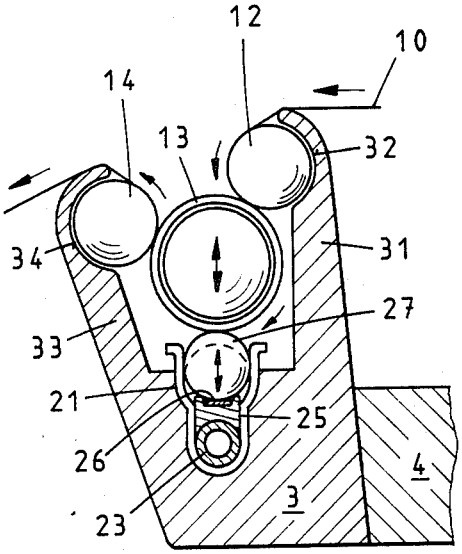
FIG. 3 illustrates a modified side view of a take-up device according to the invention.
Figure 4:
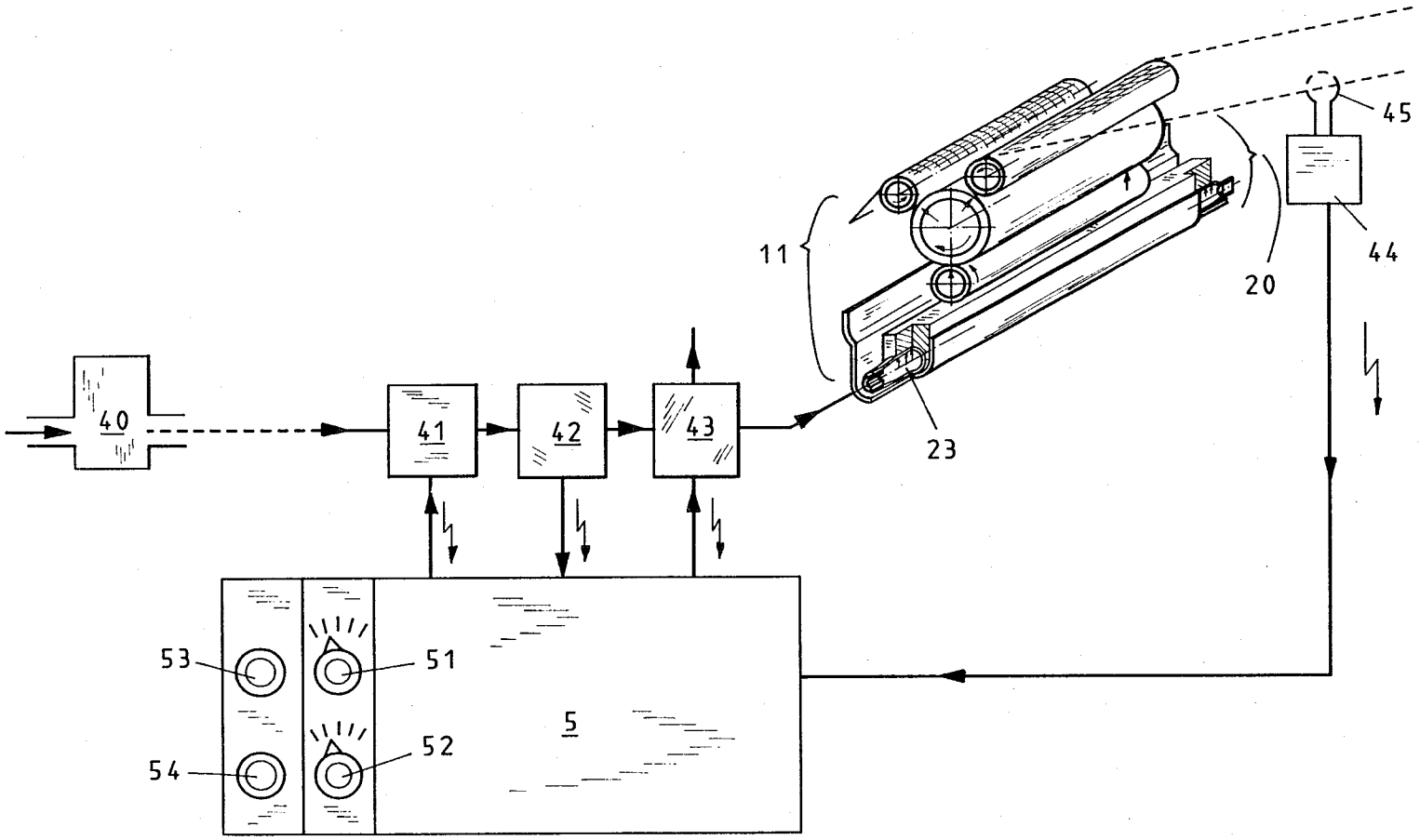
FIG. 4 illustrates a cloth take-up device controlled by a pressure controlled means in accordance with the invention.

Referring to FIGS. 3 and 4, wherein like reference characters indicate like parts as above, the take-up device 11 may use a presser in the form of a pressing roll 27 which is rotatably mounted on a bar or rod 25 made of a rubber or plastic material. As indicated, the bar 25 also has a groove in which a metal bar 26 is mounted and which provides a smooth surface on which the pressing roll 27 bears and rotates with reduced friction. In this respect, the pressing roll 27 can be made of metal or plastics.

The take-up device 11 acts particularly gently if not only the rolls 12, 13, 14 but also the pressing roll 27 are all driven at the same peripheral velocity. In this respect, the pressing roll 27 is adapted to move transversely of the longitudinal axis of the roll 27 as indicated by the double arrow in FIG. 3. In such a case, all four rolls 12, 13, 14, 27 are driven, for example, laterally through the agency of a gear box driven by the main drive of the loom through shafting and movable universal or ball joints. When the compressed air discharges from the hose 23, the roll 27 and rod 25 drop by gravity.

In order to vary the pressure which the roll 27 applies to the take-up roll 13, the pressure in the hose 23 is simply varied to suit operating requirements. For large looms producing two or more webs 10, a multi-element pressing rod or pressing roll 22, 27, i.e. one having a number of parts, can be used, for example, with one part being used for each web. A pressure hose or a pressure chamber of the hollow member 23 can then be associated with each of these parts.

Referring to FIG. 4, the take-up device may be constructed to automatically adapt the presser pressure to changing operating requirements. To this end, an air reservoir 40 is provided to supply compressed air to the hose 23 by way of a controllable valve 41, a pressure gauge 42 and a pressure release valve 43. In addition, a meter is provided to measure the warp tension continuously. As indicated, this meter includes a warp detector 45 upstream of the take-up device 11 and a converter 44 connected with the detector 45 in order to supply an electrical signal corresponding to the warp tension to a control unit 5 on a continuous basis. The control unit 5 is, in turn, provided with a yarn tension threshold value by means of a control knob 51. In addition, a control knob 52 is provided to set up the maximum permissible air pressure in the hose 23 for a particular article, i.e. the maximum permissible presser pressure.

During operation, should the signal generated by the meter 44, 45 which is representative of the warp tension overshoot the value selected by the control knob 51, the valve 41 opens so that the hose 23 is filled with compressed air from the reservoir 40. The hose pressure is measured by the pressure gauge 42 and a corresponding electrical signal is transmitted to the control electronics (not shown) of the control unit 5. When the necessary pressure has been reached, the valve 41 closes. If a lower pressure is required, air is discharged by way of the valve 43 until the pressure corresponds to the new reference pressure. This air venting step is also monitored by the pressure gauge 42.

A press button 53 is also provided on the control unit 5 and is suitably connected so that the automatic features of the unit can be cut-out at any time and the hose 23 supplied with compressed air. Conversely, a press button 54 is also provided to cut out the automatic features for the discharge of compressed air from the hose 23.

Figure 5:
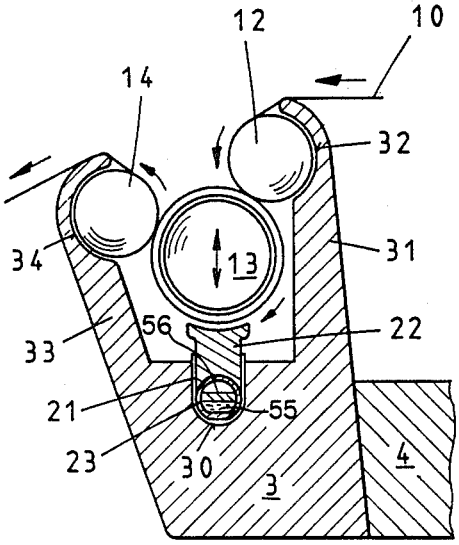
FIG. 5 illustrates a further modified take-up device in accordance with the invention.

In an alternative construction, as indicated in FIG. 5 wherein like reference characters indicate like parts as above, the hose 23 may be provided with a chamber 55 for receiving liquid and a resilient diaphram 56 to separate the liquid chamber 55 from the compressed air source (not shown).

The invention thus provides a take-up device which can be controlled from time-to-time to adjust to changing requirements.

The invention further provides a take-up device with a relatively simple structure for varying the pressure imposed by a pressure on the cloth on a take-up roll.

What is claimed is:

1. A take-up device for a cloth beam of a textile machine comprising a rotatable cylindrical take-up roll for receiving a web of cloth;

a pair of deflecting elements disposed on opposite sides of said roll for passage of the web of cloth thereover to and from said roll, said elements defining a gap therebetween of less extent than the diameter of said roll; and a pressing device for pressing said roll towards and against said deflecting elements, said device including a presser extending longitudinally of said roll and a hollow flexible-walled member abutting said presser and connectable to a pressure source for inflating said member to move said presser towards and against said roll.

2. A take-up device as set forth in claim 1 which further comprises at least one holder having said roll mounted theren.

3. A take-up device as set forth in claim 1 wherein said presser has a trough-shaped pressing surface facing said roll.

4. A take-up device as set forth in claim 1 wherein said presser has a deformable surface facing said roll.

5. A take-up device as set forth in claim 1 wherein said presser is a pressing roll movable transversely of said take-up roll.

6. A take-up device as set forth in claim 5 wherein said pressing device includes an intermediate element between said hollow member and said pressing roll.

7. A take-up device as set forth in claim 6 wherein said pressing roll is rotatably mounted on said intermediate element.

8. A take-up device as set forth in claim 5 wherein said pressing roll is rotatable at a peripheral velocity of said take-up roll.

9. A take-up device as set forth in claim 1 which further comprises a controlable pressure source connected to said hollow member to deliver a pressure medium thereto.

10. A take-up device as set forth in claim 9 which further comprises means for controlling the pressure in said hollow member in dependence upon warp tension in a loom.

11. A take-up device as set forth in claim 1 wherein said hollow member is a pressure hose of elastic material.

12. A take-up device as set forth in claim 11 wherein said hollow member includes a chamber for liquid and a resilient diaphragm separating said chamber from the pressure source.

13. A take-up device for a cloth beam of a textile machine comprising a rotatable roll for receiving a web of cloth;

a pair of deflecting elements on opposite sides of said roll for conveying the web of cloth between said roll and each respective element; and a pressing device for pressing said roll towards and against said deflecting elements, said device including a presser extending longitudinally of said roll and a hollow flexible-walled member abutting said pressure and connectable to a pressure source for inflating said member longitudinally of said presser to move said presser uniformly towards and against said roll.

14. A take-up device as set forth in claim 13 which further comprises a controllable pressure source connected to said hollow member to deliver a pressure medium thereto.

15. A take-up device as set forth in claim 13 which further comprises means for controlling the pressure in said hollow member in dependence upon warp tension in a loom.

16. A take-up device as set forth in claim 13 wherein said hollow member is a pressure hose of elastic material.

17. A take-up device for a cloth beam of a weaving machine comprising a rotatable roll for receiving a web of cloth;

a pair of deflecting elements parallel to said roll for deflecting the web of cloth over said roll;

a presser extending longitudinally of said roll; and a pressure controlled means extending longitudinally along said presser for moving said presser uniformly towards and against said roll.

18. A take-up device as set forth in claim 17 wherein said means includes a hollow flexible-walled member connectable to a pressure source for inflating said member to move said presser towards said roll.

19. A take-up device as set forth in claim 17 wherein said means includes a presser hose of elastic material.

20. A take-up device as set forth in claim 17 which further comprises a controllable pressure source connected to said hollow member to deliver a pressure medium thereto.

* * * * *

UNITED STATES PATENT AND TRADEMARK OFFICE

CERTIFICATE OF CORRECTION

PATENT NO. : 4,722,369

DATED : February 2, 1988

INVENTOR(S) : GEORG SENN

It is certified that error appears in the above-identified patent and that said Letters Patent is hereby corrected as shown below:

Column 3, lines 8 and 9 "for moving the pressing rail 22 longitudinally along the rail 22" should be -longitudinally along the rail 22 for moving the pressing rail 22-

Column 5, line 7 "theren." should be -thereon.-

Column 6, line 8 "pressure" (first occurrence) should be -presser-

Signed and Sealed this

Thirteenth Day of September, 1988

*Attest:*

*Attesting Officer*

DONALD J. QUIGG

*Commissioner of Patents and Trademarks*